US010008762B2

(12) United States Patent
Andujar Linares et al.

(10) Patent No.: US 10,008,762 B2
(45) Date of Patent: Jun. 26, 2018

(54) WIRELESS DEVICE INCLUDING OPTIMIZED ANTENNA SYSTEM ON METAL FRAME

(71) Applicant: Fractus Antennas, S.L., Barcelona (ES)

(72) Inventors: Aurora Andujar Linares, Barcelona (ES); Yolanda Cobo, Barcelona (ES); Jaume Anguera Pros, Vinaros (ES)

(73) Assignee: Fractus Antennas, S.L., Barcelona (ES)

( * ) Notice: Subject to any disclaimer, the term of this patent is extended or adjusted under 35 U.S.C. 154(b) by 0 days. days.

(21) Appl. No.: 15/411,414

(22) Filed: Jan. 20, 2017

(65) Prior Publication Data

US 2017/0214776 A1 Jul. 27, 2017

Related U.S. Application Data

(60) Provisional application No. 62/281,749, filed on Jan. 22, 2016.

(51) Int. Cl.

| | |
|---|---|
| ***H01Q 1/12*** | (2006.01) |
| ***H01Q 1/24*** | (2006.01) |
| ***H01Q 9/42*** | (2006.01) |
| ***H01Q 5/335*** | (2015.01) |
| ***H01Q 5/378*** | (2015.01) |

(52) U.S. Cl.

CPC ..... *H01Q 1/24* (2013.01); *H01Q 1/243* (2013.01); *H01Q 5/335* (2015.01); *H01Q 5/378* (2015.01); *H01Q 9/42* (2013.01)

(58) Field of Classification Search

CPC ..... H04M 1/026; H01Q 1/12

USPC ..... 455/66.1, 575.6, 575.5, 277.1, 276.1, 455/67.11; 343/767

See application file for complete search history.

(56) References Cited

U.S. PATENT DOCUMENTS

| | | | | |
|---|---|---|---|---|
| 6,023,244 | A * | 2/2000 | Snygg | H01Q 1/246 343/700 MS |
| 7,528,785 | B2 * | 5/2009 | Forster | B65D 25/205 340/572.1 |
| 2014/0139380 | A1 | 5/2014 | Ouyang et al. | |
| 2014/0300518 | A1 | 10/2014 | Ramachandran et al. | |

(Continued)

FOREIGN PATENT DOCUMENTS

| | | |
|---|---|---|
| JP | 2002223114 | 8/2002 |
| JP | 2006279159 | 10/2006 |

(Continued)

OTHER PUBLICATIONS

Bilton, N., The check is in the mail, from Apple, The New York Times, Apr. 23, 2013.

(Continued)

*Primary Examiner* — John J Lee

(74) *Attorney, Agent, or Firm* — Edell, Shapiro & Finnan LLC

(57) ABSTRACT

A wireless device such as a mobile device comprises a metal frame antenna (MFA) solution developed to cover the multiple range of frequencies required in the wireless device. An MFA includes a ground plane layer, at least a single-strip metal frame element spaced apart from an edge of the ground plane layer, and at least a feeding system that connects the at least one single-strip metal frame element to an RF transceiver of the wireless device.

5 Claims, 5 Drawing Sheets

(56) References Cited

U.S. PATENT DOCUMENTS

| | | | | |
|---|---|---|---|---|
| 2016/0028152 | A1 | 1/2016 | Anguera Pros et al. | |
| 2017/0012341 | A1* | 1/2017 | Mai | H01Q 1/243 |
| 2017/0012344 | A1* | 1/2017 | Wu | H01Q 1/243 |

FOREIGN PATENT DOCUMENTS

| | | |
|---|---|---|
| WO | 0122528 | 3/2001 |
| WO | 0154225 | 7/2001 |
| WO | 201015364 | 2/2010 |
| WO | 201015365 | 2/2010 |
| WO | 201412842 | 1/2014 |

OTHER PUBLICATIONS

Yaghjian, Arthur, Best, Steven, Impedance, Bandwidth and Q of antennas, Transactions on Antennas and Propagation, Apr. 2005, vol. 53, No. 4, p. 1298-1324, IEEE.

Saou-Wen Su and Yi-Ting Hsieh, Integrated Metal-Frame Antenna for Smartwatch Wearable Device, IEEE Transactions on Antennas and Propagation, vol. 63, No. 7, Jul. 2015, p. 3301-3305.

* cited by examiner

WIRELESS DEVICE INCLUDING OPTIMIZED ANTENNA SYSTEM ON METAL FRAME

CROSS REFERENCE TO RELATED APPLICATIONS

This application claims priority under 35 U.S.C. § 119(e) from U.S. Provisional Patent Application Ser. No. 62/281,749, filed Jan. 22, 2016, the entire contents of which are hereby incorporated by reference.

FIELD OF THE INVENTION

The present invention refers to a wireless device, and more concretely to a mobile device, which comprises a metal frame antenna (MFA) solution developed to cover the multiple range of frequencies required in said wireless device. An MFA according to the present invention comprises a ground plane layer, at least a single-strip metal frame element spaced apart from an edge of said ground plane, and at least a feeding system that connects said at least one single-strip metal frame element to the RF transceiver of the phone.

BACKGROUND

Most of the cellphones and smartphones and alike mobile devices worldwide (hereinafter 'mobile phones' or simply 'phones'), as well as other wireless devices feature a customized antenna, i.e., an antenna that is designed and manufactured ad-hoc for each device model. This is because each wireless device or, more specifically, each phone features a different form factor, a different radioelectric specification (e.g., the number and designation of mobile bands ranging for instance from GSM/CDMA 900/1800 to UMTS 2100 and the multiple LTE bands), and a different internal architecture. It is known that the relationship between antenna size and its operating wavelength is critical, and since many of the typical mobile operating wavelengths are quite large (e.g., on the order of 300 mm and longer for GSM 900 and other lower bands), fitting a small antenna inside the reduced space of mobile platform such as a smart phone is cumbersome. A typical available space inside a smart phone for an antenna is about 55×15×4 mm, which is much smaller than some of the longest operating wavelengths (e.g., below ⅙ of such a wavelength), and it is known that when antenna is made smaller than a quarter of a wavelength, both its impedance bandwidth and radiation efficiency rapidly diminish with size.

Owing to such constrains, antenna technology has evolved to provide complex antenna architectures that efficiently occupy and makes use of the maximum space available inside the mobile phone. This is enabled for instance by Multilevel (WO 0122528 A1) and Space-Filling (WO 0154225 A1) antenna technologies, which seek to optimize the antenna shape that, on a case-by-case basis, extracts the maximum radiation efficiency for each phone model.

While those technologies are flexible enough to provide an antenna solution for nearly every phone model and, therefore, have become mainstream technologies since about the beginning of the century, they still require the use of as much available space as possible inside the phone. More recently, some phones such as for instance the iPhone 4 and iPhone 5 series have introduced an antenna element that reuses an external metal frame mounted on the edge of the phone for radiation purposes. Those related solutions (hereinafter "metal frame antenna" or "MFA") potentially benefit from minimizing the use of the internal space inside the phone as the metal frame is casted on the phone perimeter. Also, the available length on the perimeter can be used to embed a metal frame antenna sufficiently large to match about a quarter of the longest wavelength of the phone. Despite these advantages, such MFA solutions still present some drawbacks. Firstly, they are usually a single length element which matches eventually well one single wavelength but not the diversity of wavelengths that are available and needed in modern cellphones. Secondly, being an external element, its functioning is susceptible of being altered by the touch of a human user, causing a sever antenna impedance detuning or bandwidth reduction (see for instance the reported 'antennagate' problem with the iPhone 4 by N. Bilton, "The Check is in the Mail, From Apple," the New York Times, Apr. 23, 2013).

FIG. 1 illustrates a typical problem related to the use of a metal frame as an antenna for a multiband system such as a cellphone. Curve (1) displays the achievable bandwidth for an example that includes a single strip frame 1 which is about the length of the upper edge of a phone (i.e., about 50 mm), as shown in FIG. 2. This curve is obtained by using a typical Electromagnetic CAD tool (e.g., IE3D) to compute the input impedance of an MFA mounted on a typical ground plane of a smartphone, and applying the achievable bandwidth equation as described in the following reference: Arthur D. Yaghjian, and Steven R. Best, "Impedance, Bandwidth, and Q of Antennas," *IEEE TRANSACTIONS ON ANTENNAS AND PROPAGATION*, VOL. 53, NO. 4, April 2005, pp. 1298-1324.

While the achievable bandwidth function in FIG. 1 has a maximum in the lower frequency region of operation of a phone, e.g., 824-960 MHz, it severely decays in the upper 1710-2690 MHz range. Such a range, where for instance multiple 3G and 4G services are located, features a relative bandwidth of about 45%, while curve (1) shows that the maximum achievable bandwidth there is about a 10%. This is because being a single strip element, the frame enters into a second resonance mode at the upper range and this mode inherently features a small bandwidth.

This means that, while the usual criteria "make the antenna as large as possible to improve bandwidth" might be valid from a single-band system perspective, is no longer true for a multiband system: while the bandwidth looks optimum for the lower frequency region, it is far from optimum in the upper frequency region.

The problem is that this curve features a single peak, and changing the length of the strip apparently should not solve the problem. Owing to the scaling principle of Maxwell Equations, one can think that scaling down the strip would result in shifting the maximum of curve (1) to higher frequencies. And indeed such a maximum can become located at the upper region, but then one should expect a sever degradation in the lower frequency range as the peak moves away from such a region. A person skilled in the art may think that an MFA solution based on a single-strip is not appropriate for a multiband or multi-region system and therefore abandon this path of work or seek a multiband solution that combines a plurality of strips to accommodate the plurality of frequency regions and frequency bands of a phone.

It is the purpose of the present invention to provide an MFA antenna solution that fulfills the electromagnetic, radioelectric, mechanical and aesthetics requirements of a phone, particularly a smartphone or smartphone-like device. The present invention can also be extended to other wireless devices.

SUMMARY

It has been found that an MFA antenna system can be developed to cover the multiple range of frequencies required in a wireless device or, more specifically a phone, when arranged according to the present invention. The devices related to this invention operate in at least one frequency band in at least one frequency region, the frequency band being a range of frequencies used by a particular communication standard, and the frequency region being a continuum of frequencies of the electromagnetic spectrum. An MFA according to the present invention comprises a ground plane layer, at least a single-strip metal frame element spaced apart from an edge of said ground plane, and at least a feeding system that connects said at least one single-strip metal frame element to the RF transceiver of the phone. Generally, the single-strip metal frame has a length preferably greater than 1/25 times a free-space wavelength corresponding to the lowest frequency of operation of the device and preferably smaller than 1/2.8 times a free-space wavelength corresponding to the highest frequency of operation of the device, or preferably between 1/23 times the highest wavelength of operation and 1/3.7 times the lowest wavelength of operation. A typical length of said single-strip metal frame element, for operation within the frequency range that goes from 600 MHz to 3000 MHz, ranges from 20 mm to 35 mm, yet preferably a length between 22 mm and 27 mm such as for instance a value on the order of 25 mm.

A first embodiment of an MFA according to the present invention is shown in FIG. 3. For this specific example and platform dimensions, it has been found that by reducing the length of the single strip metal frame to about half of the length of the shorter edge of the phone the achievable bandwidth in the first frequency region of interest, going from 600 MHz to 1000 MHz, is reduced as well, but such a bandwidth still meets the requirement of a typical phone when such a length is kept within a range, as described in the present invention. Though, the achievable bandwidth becomes greatly enhanced in the upper frequency region (from 1,700 MHz to 3,000 MHz), peaking a maximum bandwidth beyond 45% around 2 GHz, as shown in FIG. 1, curve (2), which corresponds to the MFA arrangement in FIG. 3.

Some other embodiments comprise at least a feeding system that includes a strip line protruding out of the ground plane layer, said strip line connecting to the single-strip metal frame element at one end and to a matching network at the other end. The matching network tunes the impedance of the strip set (including at least the line and the metal frame ones) to match the input/output impedance of the RF transceiver port in the phone.

In some embodiments, such a feeding system also includes a boosting element or an antenna booster element, defined in WO2010/15365 A2, such as for instance those described in WO2010/15365 A2, WO2010/15364 A2, WO2014/12842 A1 and US Patent Publication 2016/0028152 and US Patent Application No. 62/152,991 which are incorporated by reference herein. In some of these embodiments, such a booster or boosting element is connected to the single-strip metal frame element at a first point and to a strip line at a second point. Examples of commercial booster elements suitable for the present invention are for instance Fractus® mXTEND, mXTEND RUN and mXTEND BAR range of products.

While the performance of the embodiment in FIG. 3 is appropriate in terms of performance for a phone platform but the short metal frame element featuring a size that does not cover about the whole edge of the phone appears visually awkward as it covers only a portion of the external edge. From an aesthetics perspective, the best solution is to include a metal frame element which is about the whole length of the shorter edge of the phone but then that option becomes problematic from the electromagnetic performance perspective as discussed (FIG. 3).

Another embodiment of the present invention (FIG. 7) solves both the performance and aesthetics issue by placing a second floating metal frame element adjacent to said first metal frame element and unconnected from such. A suitable length for this second adjacent metal frame for this platform dimensions ranges between 15 mm and 40 mm. This embodiment includes a small gap between the first and second metal frame segments. A small gap according to the present invention is a gap between conducting elements of a size within 0.1 mm and 3 mm, and preferably on the order of 1 mm. In some embodiments such a gap is implemented as an air gap. In other embodiments said gap is implemented by filling it with a non-conducting material such as for instance a dielectric material.

The achievable bandwidth for this embodiment is shown in FIG. 1 (3). As seen there, the performance is very close to that of the embodiment in FIG. 2, yet the aesthetics is very much similar to that of a full-frame solution that covers the entire phone edge.

DETAILED DESCRIPTION

An MFA antenna system according to the present invention is shown in the following examples without any limiting purpose. An MFA antenna system comprises a ground plane typically implemented as a ground metal layer on a multi-layer printed circuit board (PCB). The size of such a ground plane might be, for a smart phone, on the order of 50 mm to 65 mm on the shorter edge, and about 120 mm to 150 mm on the longer edge and quite typically, around 55 mm×135 mm.

Figure 1:
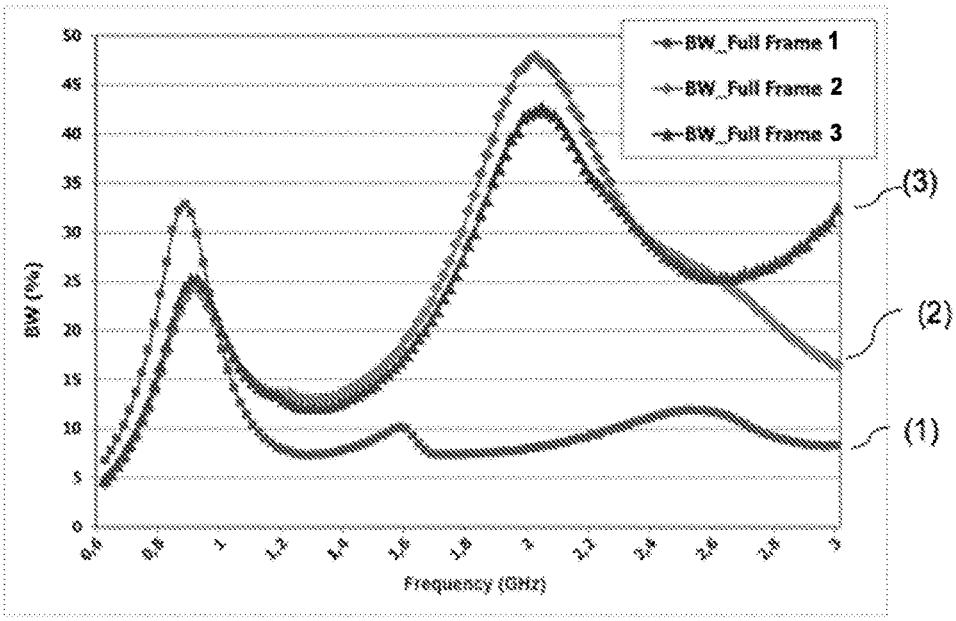
FIG. 1 shows a graph on the achievable bandwidth (BW) as a function of frequency for a full strip MFA solution (1) compared to the performance of embodiments in FIGS. 2 and 3 of the present invention (curves (2) and (3) respectively).
Figure 2:
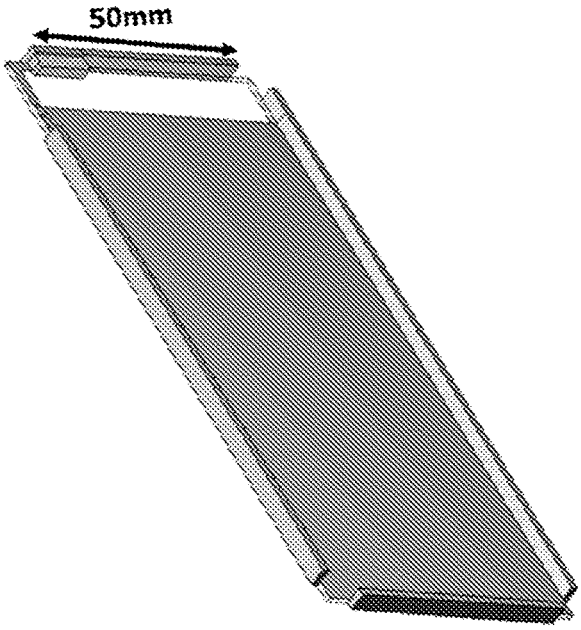
FIG. 2 illustrates an example of an MFA solution with a single strip metal frame of length on the order of the length of the upper edge of a phone.
Figure 3:
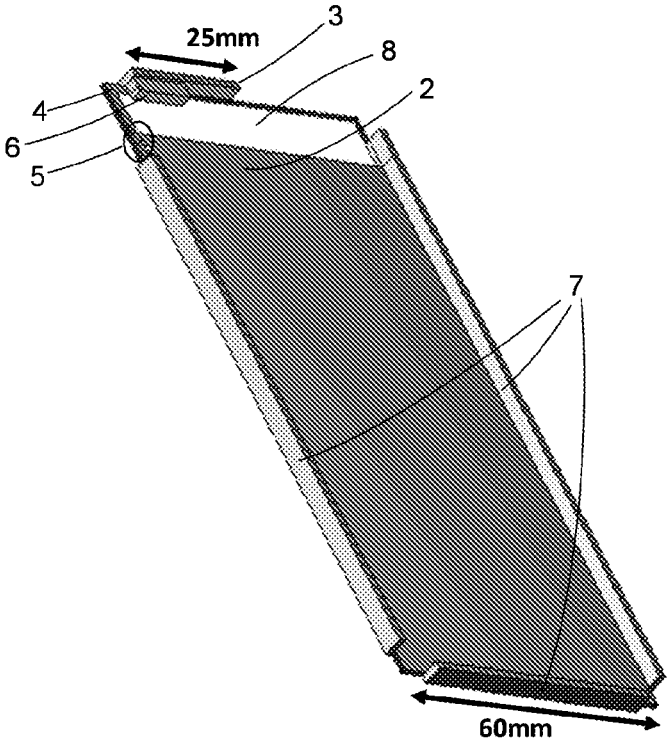
FIG. 3 shows an MFA solution including a single strip metal frame MFA with an optimized length according to the present invention.

FIG. 3 shows an example comprising a ground plane layer 2 and a single-metal frame element 3 connected to the RF transceiver of the device by means of a feeding system. A feeding system connecting said frame element to the RF transceiver includes an L-shaped floating line 4 which is connected to a matching network 5 at a first end and to an antenna booster or boosting element 6 to a second end. Said antenna booster is in this example a Fractus® mXTEND product (e.g., FR01-54-250, FR01-54-232, FR01-54-224). Said antenna booster is connected at a first point to said single-strip metal frame element and to the L-shaped floating line at a second point. In this example, the ground plane layer is also surrounded by 3 metal grounding strips 7 for a metal frame whose main function is providing a structural mechanical element for the phone while using such an element for the aesthetics finishing of the device. One of the edges of the device (the upper edge in FIG. 3) features a clearance area 8 where the ground plane layer is removed. Such a clearance area spaces apart the edge of the ground plane with a first single-strip metal frame element that is connected to the RF transceiver of the phone by means of a feeding system. For the typical frequencies of a phone ranging 600 MHz up to about 3,000 MHz, the spacing between a first metal frame element and the edge of the ground plane is between 1 mm and 20 mm, and typically between 10 to 15 mm.

Figure 4:
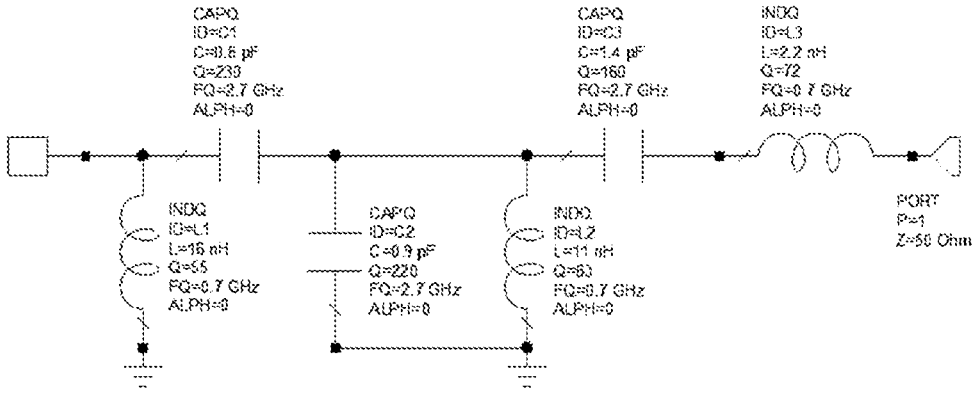
FIG. 4 provides the matching network used to match the embodiment presented in FIG. 2.
Figure 5:
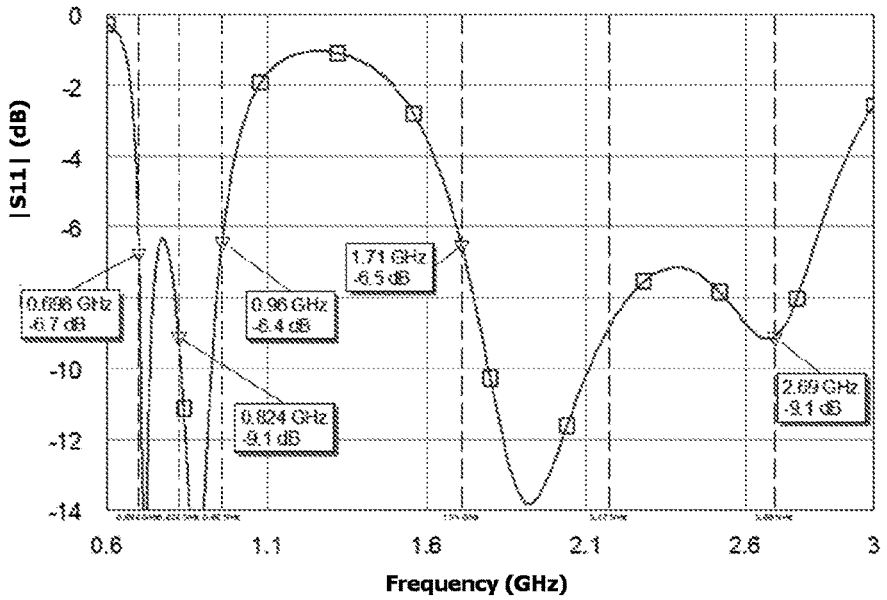
FIG. 5 shows the input reflection coefficient related to the embodiment shown in FIG. 2 matched with the matching network provided in FIG. 4.
Figure 6:
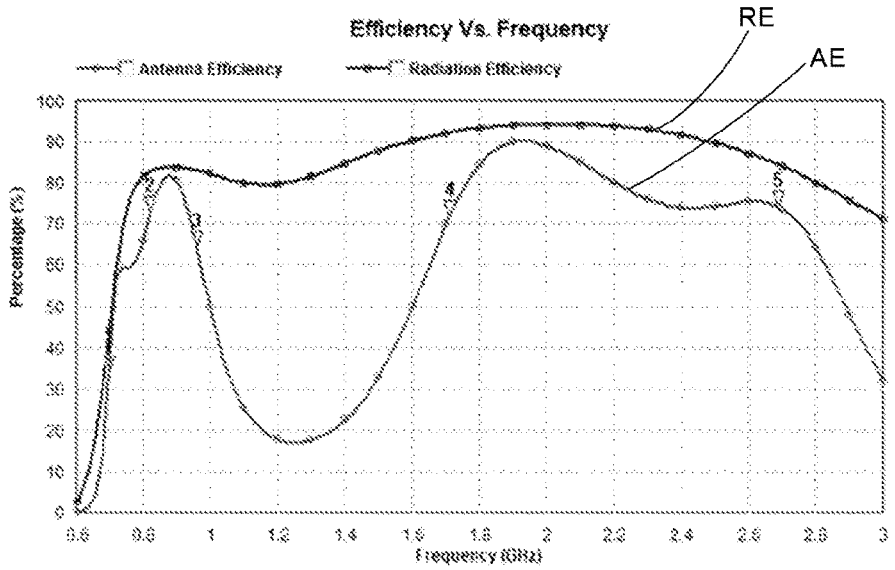
FIG. 6 presents the radiation and antenna efficiencies related to the embodiment shown in FIG. 2 matched with the matching network provided in FIG. 4.

FIG. 4 provides the matching network 5 comprised in the feeding system of the embodiment shown in FIG. 3 and used to match it. FIG. 5 shows the input reflection coefficient related to said embodiment, which covers LTE700, GSM850, GSM900, LTE1700, GSM1800, GSM1900, UMTS2100, LTE2300, LTE2500 and LTE2600 mobile bands, if taking into account a maximum threshold of −6 dB. FIG. 6 represents the radiation RE and antenna efficiencies AE of the example provided in FIG. 3. Such example features an antenna efficiency average of 67.3% in the range of low frequencies 698 MHz-960 MHz and an antenna efficiency average of 79.9% in the range of high frequencies 1.71 GHz-2.69 GHz.

Figure 7:
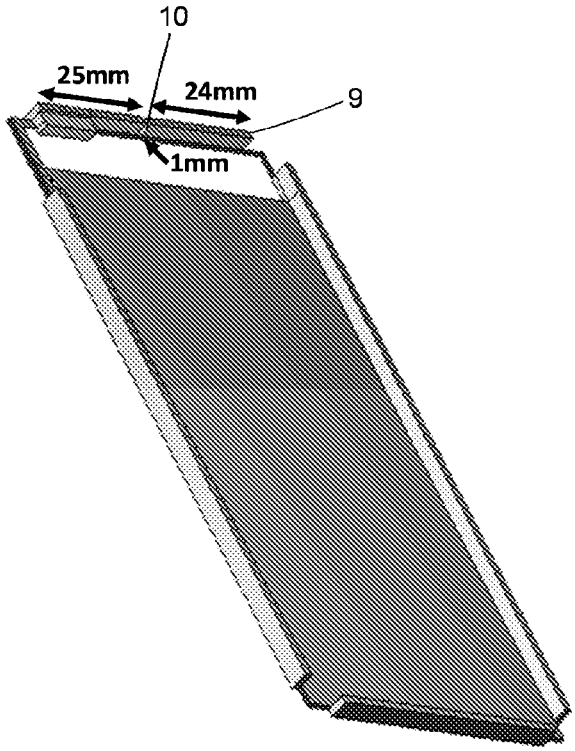
FIG. 7 illustrates an MFA solution including a single strip metal frame MFA with an optimized length according to the present invention and an adjacent floating, non-coupled element.

FIG. 7 provides an embodiment that additionally comprises a floating second metal frame element 9 adjacent to the first single-strip metal frame element and unconnected from said single-strip metal frame element. Said floating, unconnected second strip features a similar size to the first one (e.g., 15 mm to 40 mm) so that, all together, they cover about the whole upper edge of the device in FIG. 7. Such example includes a gap 10 of width 1 mm that spaces said first and second metal frame elements. Such a gap minimizes the coupling between metal frame elements and preserves the achievable bandwidth about the same as the one achievable without the presence of the floating metal frame element.

Figure 8:
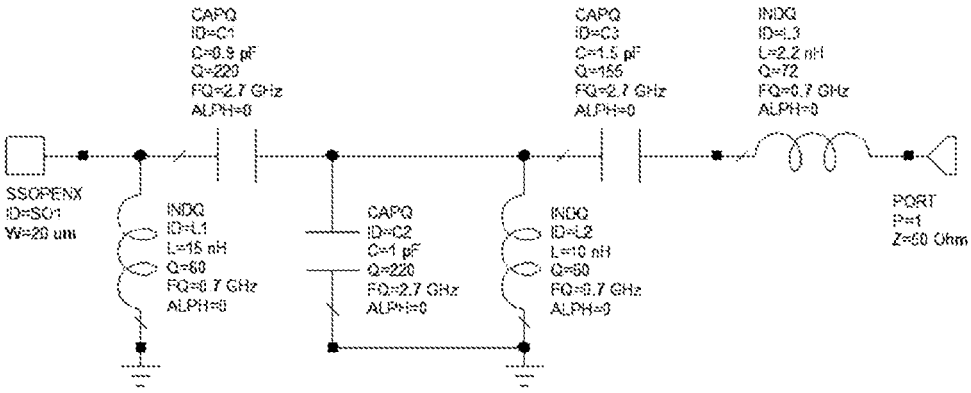
FIG. 8 presents the matching network used to match the example from FIG. 7.
Figure 9:
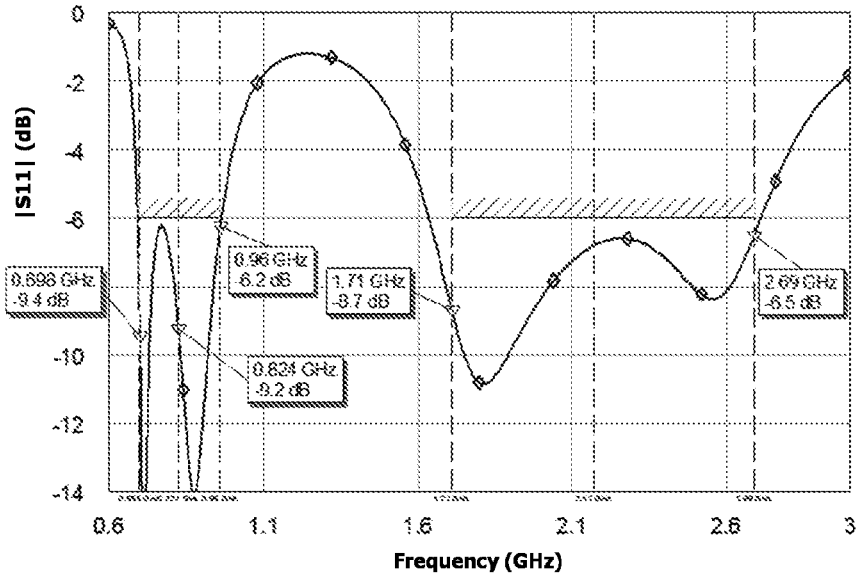
FIG. 9 shows the input reflection coefficient related to the example provided in FIG. 7.
Figure 10:
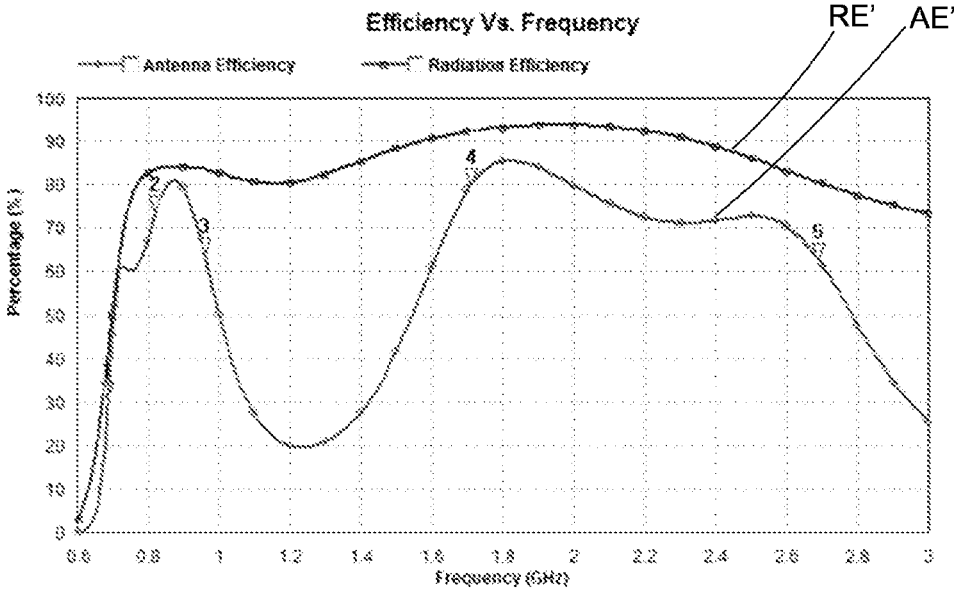
FIG. 10 shows the radiation and antenna efficiencies related to the example from FIG. 7.

FIG. 8 provides the feeding system matching network used to match the embodiment shown in FIG. 7 that comprises an additional floating second metal frame element. FIG. 9 shows the input reflection coefficient related to said embodiment, which covers LTE700, GSM850, GSM900, LTE1700, GSM1800, GSM1900, UMTS2100, LTE2300, LTE2500 and LTE2600 mobile bands, when taking into account a maximum threshold of −6 dB criteria. FIG. 10 provides the radiation efficiency RE' and the antenna efficiency AE' related to the embodiment pictured in FIG. 8. This example features an antenna efficiency average of 68.3% in the 698 MHz-960 MHz range of low-frequency region and an antenna efficiency average of 75.4% in the 1.71 GHz-2.69 GHz range of high-frequency region.

What is claimed is:

1. A metal frame antenna system for a wireless or mobile device comprising:

a ground plane layer;

a single-strip metal frame element spaced apart from one edge of the ground plane layer;

a feeding system connecting the single-strip metal frame element to an RF transceiver of said device;

a floating metal frame element adjacent to the single-strip metal frame element and unconnected from the single-strip metal frame element, with a gap between the single-strip metal frame element and the floating metal frame element, wherein the wireless or mobile device operates within a 600 MHz to 3000 MHz frequency range and a length of the single-strip metal frame element is between 20 mm and 35 mm, and the length of the floating metal frame element is between 15 mm and 40 mm.

2. The metal frame antenna system of claim 1, wherein the length of the single-strip metal frame element is between 22 mm and 27 mm.

3. The metal frame antenna system of claim 1, wherein the at least a feeding system comprises a strip line connecting to a matching network at a first end and to the single-strip metal frame element at a second end.

4. The metal frame antenna system of claim 1, wherein the at least a feeding system further comprises at least a boosting element.

5. The metal frame antenna system of claim 1, wherein the at least a feeding system further comprises at least a boosting element connected to the single-strip metal frame element.

* * * * *